US007059905B2

(12) United States Patent
Tanaka

(10) Patent No.: US 7,059,905 B2
(45) Date of Patent: Jun. 13, 2006

(54) CONNECTOR HAVING AN EXCELLENT TRANSMISSION CHARACTERISTIC AND AN EXCELLENT EMI SUPPRESSION CHARACTERISTIC

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/903,304

(22) Filed: Jul. 29, 2004

(65) Prior Publication Data

US 2005/0032425 A1 Feb. 10, 2005

(30) Foreign Application Priority Data

Aug. 6, 2003 (JP) ..... 2003-287997

(51) Int. Cl.
*H01R 13/648* (2006.01)

(52) U.S. Cl. ..... 439/607

(58) Field of Classification Search ..... 439/607, 439/608, 108, 609, 101, 610
See application file for complete search history.

(56) References Cited

U.S. PATENT DOCUMENTS 4,602,831 A 7/1986 Lockard
4,975,084 A * 12/1990 Fedder et al. ..... 439/608
5,073,130 A * 12/1991 Nakamura ..... 439/607
5,281,169 A * 1/1994 Kiat et al. ..... 439/607
6,183,302 B1 * 2/2001 Daikuhara et al. ..... 439/608
6,350,134 B1 * 2/2002 Fogg et al. ..... 439/79
6,547,595 B1 4/2003 Tanaka
6,712,646 B1 * 3/2004 Shindo ..... 439/608
2004/0242072 A1 * 12/2004 Kumamoto et al. ..... 439/608

FOREIGN PATENT DOCUMENTS

JP 60-109186 A 6/1985
JP 2002-198131 A 7/2002
JP 2002-270307 A 9/2002

* cited by examiner

*Primary Examiner*—Chandrika Prasad
(74) *Attorney, Agent, or Firm*—Frishauf, Holtz, Goodman & Chick, P.C.

(57) ABSTRACT

In a connector including signal and shield contacts which are conductive, a housing holds the signal and the shield contacts. The shield contact has a holding portion held by the housing. In the shield contact, a contacting portion extends from the holding portion and adapted to be contacted with a mating object. A shielding portion extends from the holding portion to cover a portion of the signal contact. A terminal portion extends from the shielding portion and adapted to be connecting with ground.

10 Claims, 7 Drawing Sheets

CONNECTOR HAVING AN EXCELLENT TRANSMISSION CHARACTERISTIC AND AN EXCELLENT EMI SUPPRESSION CHARACTERISTIC

This application claims priority to prior Japanese application JP 2003-287997, the disclosure of which is incorporated herein by reference.

BACKGROUND OF THE INVENTION

This invention relates to an electrical connector and, in particular, to a connector suitable for transmission of a high-frequency signal used in a communication apparatus or the like.

Recently, a DVI (Digital Visual Interface) is known as one of standards for an interface connecting a computer and a display. In the DVI, a serial transmission method called TMDS (Transition Minimized Differential Signaling) is used. According to the DVI, a digital signal can directly be sent from the computer to a digital display, i.e., a digitally-driven display. It is therefore possible to reduce signal degradation as a result of conversion from the digital signal into an analog signal. An electrical connector in conformity with the DVI will hereinafter be called a DVI connector.

In the DVI connector also, EMI protection is required as in a connector disclosed, for example, in Japanese Patent Application Publication (JP-A) 2002-270307 (corresponding to U.S. Pat. No. 6,547,595). The connector illustrated in JP-A 2002-270307 comprises a plurality of conductive contacts and a housing holding the contacts. The contacts are generally classified into a plurality of signal contacts and a plurality of shield contact for electromagnetically shielding the signal contacts. The shield contact has a shielding portion and serves to achieve impedance matching of the signal contacts and to thereby reduce insertion loss. In addition, one of the signal contacts farther from the shield contact is covered with the shielding portion so as to achieve impedance matching between the signal contacts.

Referring to FIG. 1, description will be made about a relationship between the signal contacts and the shield contact in the connector with EMI protection. In FIG. 1, a shield contact 3 is disposed adjacent to two signal contacts 1 and 2. The shield contact 3 has a main body portion 4 and a shielding portion 5 extending from the main body portion 4. The shielding portion 5 covers the signal contacts 1 and 2.

However, the shielding portion 5 has a plurality of protruding ends 6 which are not electrically terminated but electrically opened. This may result in electrical reflection at these protruding ends 6 and occurrence of noise.

SUMMARY OF THE INVENTION

It is therefore an object of this invention to provide a connector having an excellent transmission characteristic and an excellent EMI suppression characteristic for a high-frequency signal and a high-speed signal by eliminating a noise source in a shield contact.

Other objects of the present invention will become clear as the description proceeds.

According to an aspect of the present invention, there is provided a connector comprising a first signal contact being conductive, a shield contact being conductive, and a housing holding the first signal contact and the shield contact. The shield contact comprises a holding portion held by the housing, a contacting portion extending from the holding portion and adapted to be contacted with a mating object, a shielding portion extending from the holding portion to cover a portion of the first signal contact, and a terminal portion extending from the shielding portion and adapted to be connecting with ground.

According to another aspect of the present invention, there is provided a connector comprising plural contact sets. Each of the contact sets comprises a first signal contact being conductive, a shield contact being conductive, and a housing holding the first signal contact and the shield contact. The shield contact comprises a holding portion held by the housing, a contacting portion extending from the holding portion and adapted to be contacted with a mating object, a shielding portion extending from the holding portion to cover a portion of the first signal contact, and a terminal portion extending from the shielding portion and adapted to be connecting with ground.

DESCRIPTION OF THE PREFERRED EMBODIMENTS

Figure 1:
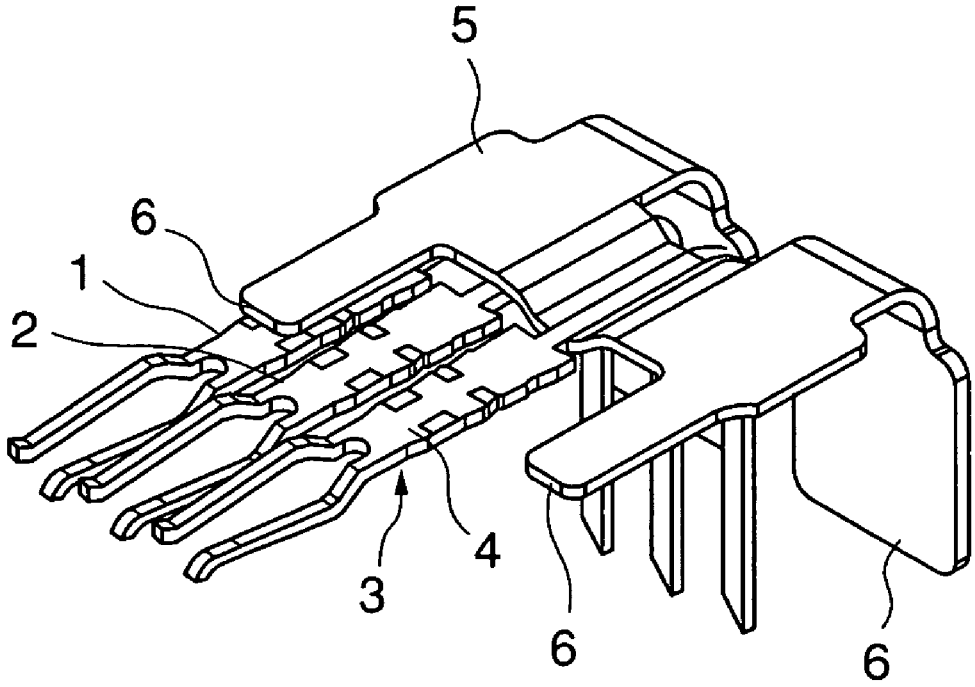
FIG. 1 is a perspective view showing a relationship between signal contacts and a shield contact in a conventional connector.
Figure 2:
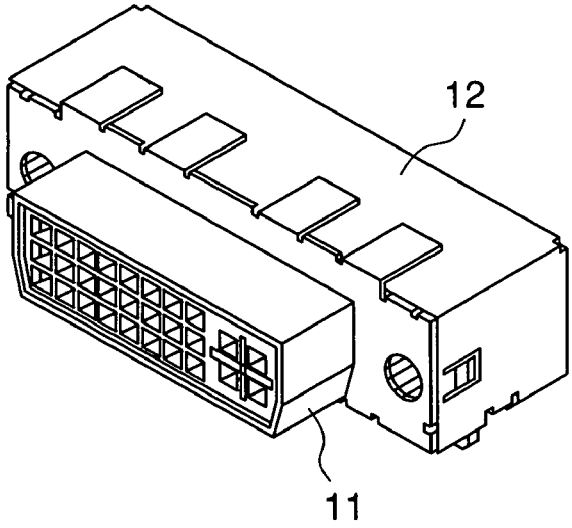
FIG. 2 is a front perspective view of a connector according to one embodiment of this invention.
Figure 3:
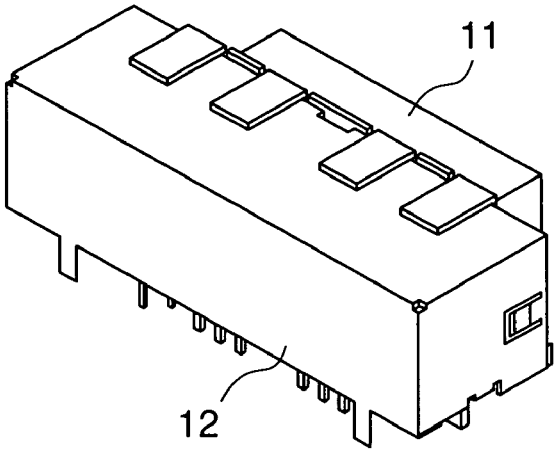
FIG. 3 is a rear perspective view of the connector illustrated in FIG. 2.
Figure 4:
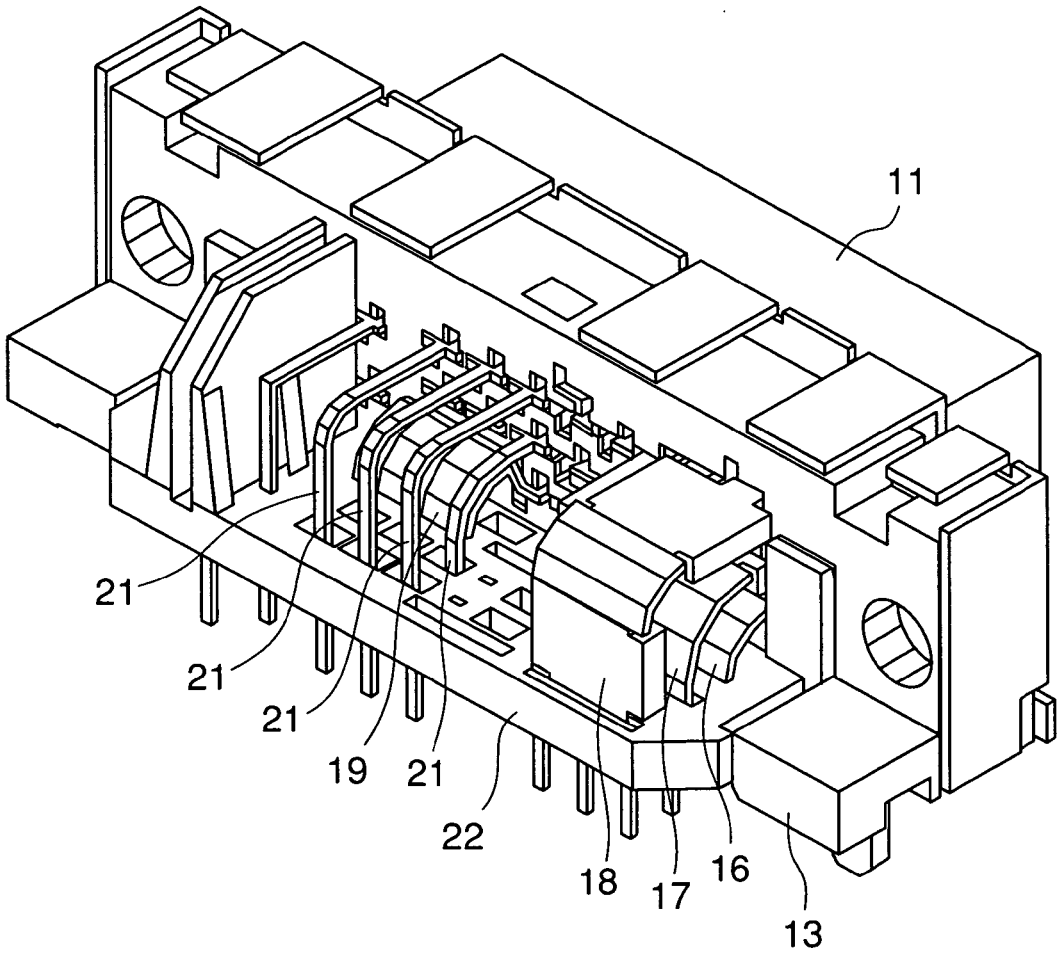
FIG. 4 is an enlarged rear perspective view of the connector illustrated in FIG. 2 in a state where a back shell is removed.
Figure 5:
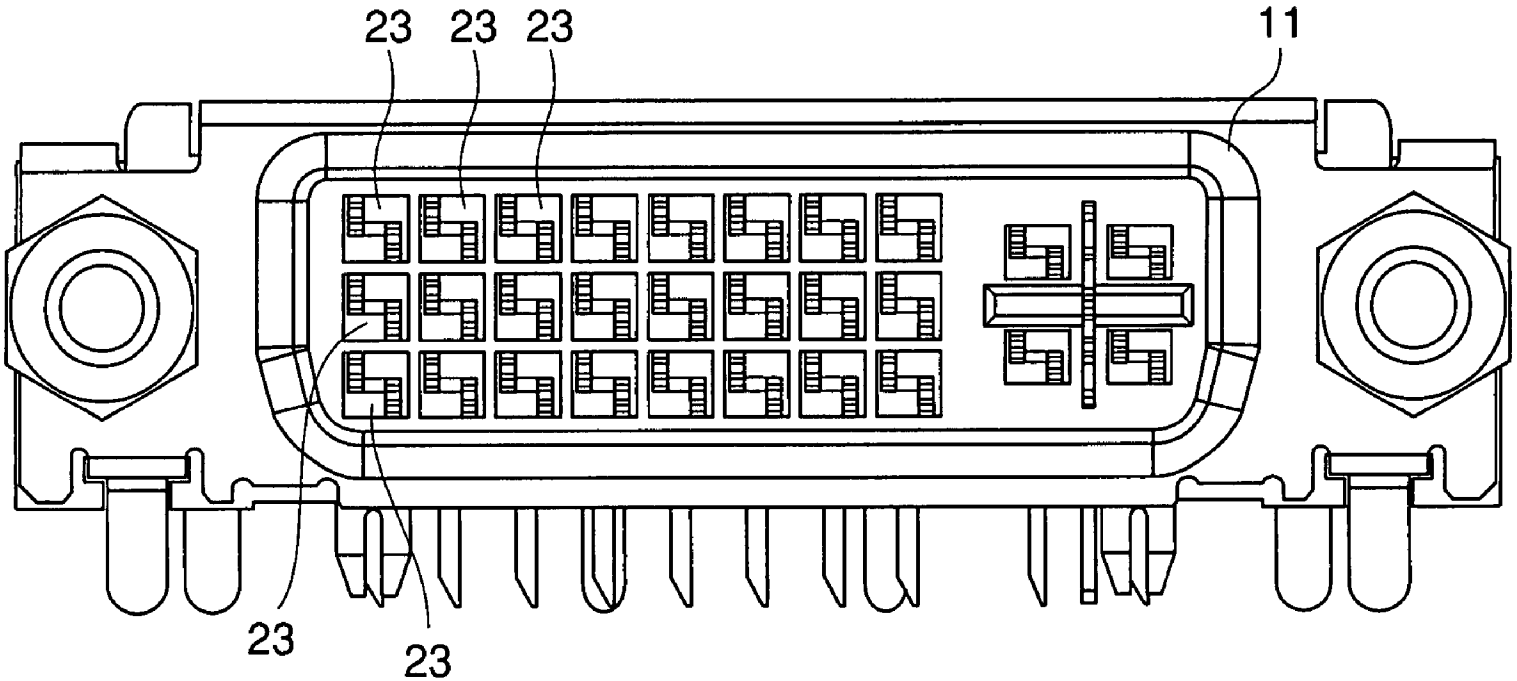
FIG. 5 is an enlarged front view of the connector illustrated in FIG. 2.

Referring to FIGS. 2 through 5, a connector according to one embodiment of this invention will be described.

The connector illustrated in the figure is a DVI connector and comprises a box shell constituted by a front shell 11 and a back shell 12 coupled to the front shell 11, and a housing 13 fitted inside the box shell. Each of the front shell 11 and the back shell 12 is made of a metal material. The housing 13 is made of an insulating material such as plastic.

The housing 13 fixedly holds a first contact set 16, a second contact set 17, a third contact set 18, a fourth contact set 19, and a plurality of other conductive contacts 21. The first contact set 16, the second contact set 17, the third contact set 18, the fourth contact set 19, and the conductive contacts 21 are positioned by a location plate 22 so that contacting portions to be contacted with a mating object are regularly arranged as schematically shown by reference numerals 23 in FIG. 5.

Figure 6:
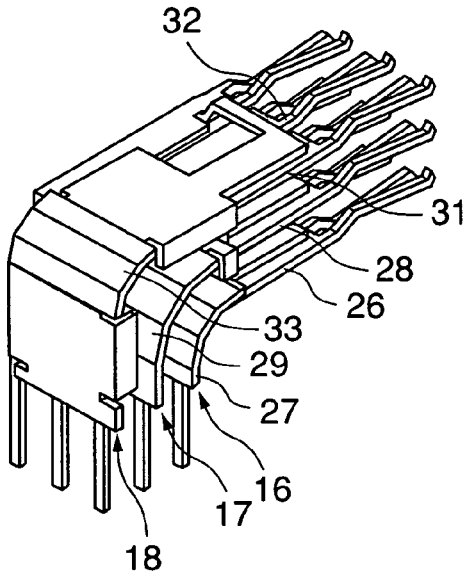
FIG. 6 is a perspective view of a plurality of contact sets taken out from the connector illustrated in FIG. 2.

Referring to FIG. 6, the first through the third contact sets 16, 17, and 18 will be described.

The first contact set 16 includes two conductive signal contacts (only one being illustrated in the figure) 26 and a conductive shield contact 27 arranged outside the signal contacts 26 and adjacent thereto. The second contact set 17 includes two conductive signal contacts (only one being illustrated in the figure) 28 arranged outside the shield contact 27 and adjacent thereto, and a conductive shield contact 29 arranged outside the signal contacts 28 and adjacent thereto. The third contact set 18 includes two conductive signal contacts 31 and 32 arranged outside the shield contact 29 and adjacent thereto, and a conductive shield contact 33 arranged outside the signal contacts 31 and 32 and adjacent thereto. Thus, the first through the third contact sets 16, 17, and 18 are similar in structure to one another.

Figure 7:
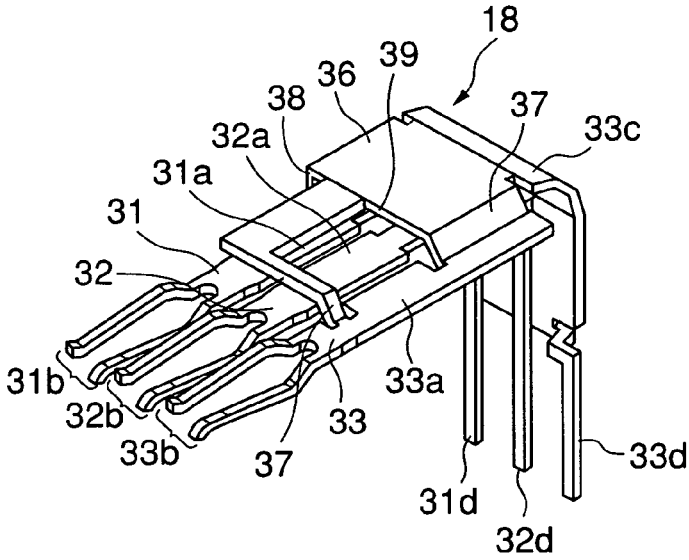
FIG. 7 is a perspective view of one of the contact sets in FIG. 6.
Figure 8:
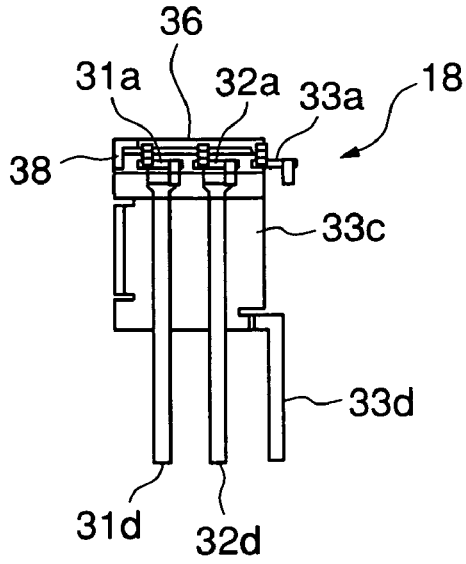
FIG. 8 is a front view of the contact set illustrated in FIG. 7.
Figure 9:
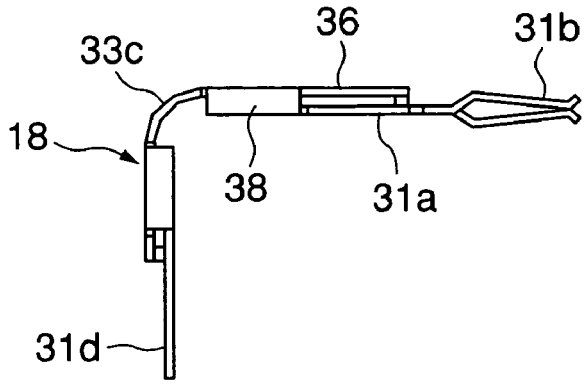
FIG. 9 is a left side view of the contact set illustrated in FIG. 7.

Referring to FIGS. 7 through 9, the third contact set 18 will be described as a representative of the first through the third contact sets 16, 17, and 18.

The shield contact 33 of the third contact set 18 has a holding portion 33*a* held by the housing 13, a contacting portion 33*b* connected to the holding portion 33*a* and adapted to be contacted with the mating object, a shielding portion 33*c*, and a terminal portion 33*d* to be connected to a circuit board (not shown) or the like.

The signal contacts 31 and 32 have holding portions 31*a* and 32*a* disposed adjacent to the holding portion 33*a* of the shield contact 33 and held by the housing 13, contacting portions 31*b* and 32*b* connected to one ends of the holding portions 31*a* and 32*a* and adapted to be contacted with the mating object, terminal portions 31*d* and 32*d* connected to the other ends of the holding portions 31*a* and 32*a* and adapted to be connected to the circuit board (not shown) or the like, respectively. The holding portions 31*a*, 32*a*, and 33*a* are arranged in parallel to one another in one plane. The contacting portions 31*b*, 32*b*, and 33*b* are arranged in parallel to one another in one plane. The terminal portions 31*d*, 32*d*, and 33*d* are arranged in parallel to one another in one plane.

The shielding portion 33*c* of the shield contact 33 has a plate-like portion 36 faced to the signal contacts 31 and 32 with a gap formed therebetween, a connecting portion 37 formed between one end of the plate-like portion 36 and the holding portion 33*a* and connecting the one end of the plate-like portion 36 and the holding portion 33*a* different in level from each other, and a bent portion 38 bent and extending from the other end of the plate-like portion 36 to face the connecting portion 37. Thus, the signal contacts 31 and 32 are at least partially covered with the plate-like portion 36, the connecting portion 37, and the bent portion 38. The shielding portion 33*c* covers both of the signal contacts 31 and 32. The plate-like portion 36 may be provided with an opening portion 39 corresponding to at least one of the holding portions 31*a* and 32*a* of the signal contacts 31 and 32. In the illustrated example, the opening portion 39 corresponds to the holding portion 32*a* that is adjacent to the holding portion 33*a* of the shield contact 33.

In other words, the plate-like portion 36 is formed as a ground plate covering the holding portion 31*a* of one signal contact 31 without covering the holding portion 32*a* of the other signal contact 32. The terminal portion 33*d* is connected to the plate-like portion 36 with a stepped portion formed therebetween.

With the above-mentioned structure, the plate-like portion 36 of the shield contact 33 serves to achieve impedance matching and shielding to eliminate a noise source. It is therefore possible to suppress superposition of noise upon a TMDS signal. Further, an end portion of the plate-like portion 36 is connected to the holding portion 33*a* to form an electrical loop so that electrical reflection is suppressed. This also contributes to reduction of noise.

Figure 10:
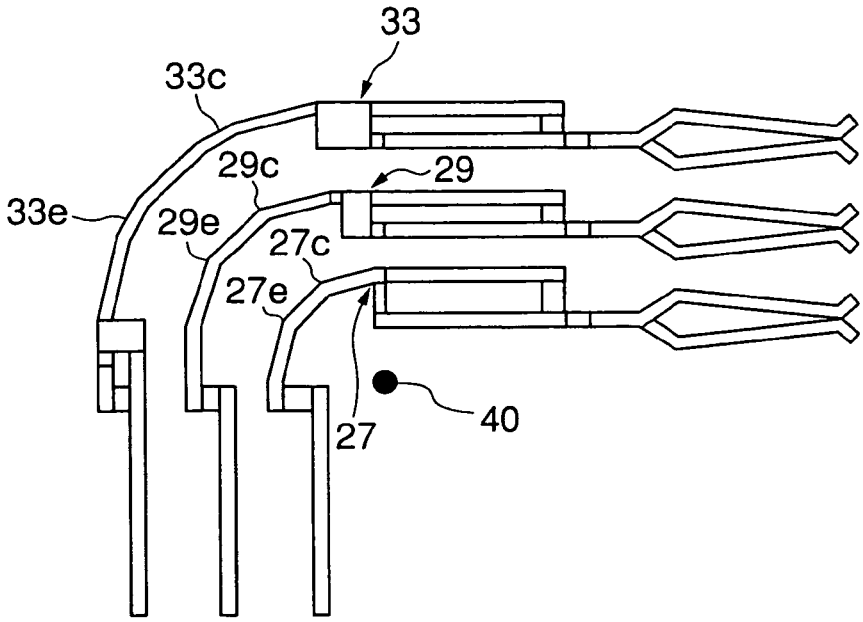
FIG. 10 is a side view showing a relationship among shield contacts in the contact sets in FIG. 6.

Referring to FIG. 10, description will be made of a relationship among the shield contacts 27, 29, and 33 which is applicable to the DVI connector.

In FIG. 10, the shielding portion 27*c*, 29*c*, and 33*c* have angled or curved portions 27*e*, 29*e*, and 33*e* curved substantially along arcs around a common center point 40, respectively. In this case, the signal contacts 26, 28, 31, and 32 are curved like the shield contacts 27, 29, and 33, although not shown in FIG. 10. Furthermore, in order that the signal contacts 26, 28, 31, and 32 and the shield contacts 27, 29, and 33 are equally spaced in a radial direction, angled or curved portions of the signal contacts have centers of curves coincident with the common center point 40 of the angled or the curved portions 27*e*, 29*e*, and 33*e* of the shielding portions 27*c*, 29*c*, and 33*c*.

With the above-mentioned structure, the spaces among the signal contacts in the radial direction are substantially equal to each other. In addition, the spaces among the signal contacts and the shielding portions of the shield contacts in the radial direction are also substantially equal to each other. Therefore, it is possible to decrease a discontinuous portion among these contacts. This results in suppressing the reflection known in the art.

The angled or the curved portion of the signal contact or the shield contact is curved with three or more stages of bending in FIG. 10. Alternatively, the angled or the curved portion may be curved with two stages of bending or may smoothly be curved along an arc.

Figure 11:
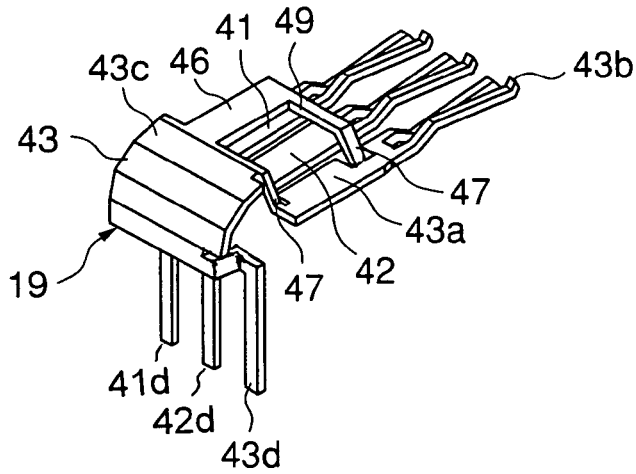
FIG. 11 is a perspective view of another contact set.

Referring to FIG. 11, the fourth contact set 19 will be described.

The fourth contact set 19 is similar in structure to the third contact set 18 and comprises two conductive signal contacts 41 and 42, and a conductive shield contact 43 disposed outside the signal contacts 41 and 42 and adjacent thereto. The shield contact 43 of the fourth contact set 19 has a holding portion 43*a* held by the housing 13, a contacting portion 43*b* connected to the holding portion 43*a* and adapted to be contacted with the mating object, a shielding portion 43*c*, and a terminal portion 43*d* connected to the circuit board (not shown) or the like.

The shielding portion 43*c* of the shield contact 43 has a plate-like portion 46 faced to the signal contacts 41 and 42 with a gap formed therebetween, a connecting portion 47 formed between one end of the plate-like portion 46 and the holding portion 43*a* and connecting the one end of the plate-like portion 46 and the holding portion 43*a* different in level from each other, and a bent portion (not shown) bent and extending from the other end of the plate-like portion 46 to face the connecting portion 47. Thus, the signal contacts 41 and 42 are at least partially covered with the plate-like portion 46, the connecting portion 47, and the bent portion. The plate-like portion 46 may be provided with an opening portion 49 corresponding to a part of the signal contacts 41 and 42. The terminal portion 43*d* is connected to the plate-like portion 46 with a stepped portion formed therebetween and is arranged coplanar with terminal portions 41*d* and 42*d* of the signal contacts 41 and 42.

The above-mentioned connector does not have protruding ends as a noise source in the shielding portion of the shield contact. Therefore, the above-mentioned connector has an excellent transmission characteristic and an excellent EMI characteristic for a high-frequency signal and a high-speed signal.

In the foregoing, description has been made of the case where the signal contacts are fitted to all of a plurality of predetermined positions. However, the contacts may not be fitted to those of the predetermined positions which are covered with the shielding portion, thereby suppressing the reflection as a factor causing occurrence of noise.

This invention is applicable to a high-speed transmission connector required to achieve impedance matching, for example, connectors in conformity with USB2.0, Infini Band, and PCI express.

While this invention has thus far been described in conjunction with the preferred embodiment thereof, it will be readily possible for those skilled in the art to put this invention into practice in various other manners. For example, the housing 2 may have one side portion and the flexible board 11 may have one protruding portion.

What is claimed is:

1. A connector comprising:

a conductive first signal contact which comprises a contacting portion;

a conductive second signal contact which comprises a contacting portion positioned parallel to the contacting portion of the first signal contact in a plane;

a conductive shield contact; and a housing holding said first signal contact, said second signal contact and said shield contact, wherein said shield contact comprises:

a holding portion held by said housing;

a contacting portion which extends from said holding portion and in said plane in which the contacting portions of the first and second signal contacts are parallel, and which is adapted to be contacted with a mating object;

a shielding portion extending from said holding portion to cover a portion of said first signal contact and a portion of said second signal contact; and a terminal portion extending from said shielding portion and adapted to be connecting with ground.

2. The connector according to claim 1, wherein said shielding portion comprises:

a plate-like portion facing said first signal contact;

a connecting portion bent from one end of said plate-like portion and connected to said holding portion; and a bent portion bent from an opposite end of said plate-like portion to face said connecting portion;

wherein said first signal contact is at least partially covered with said plate-like portion, said connecting portion, and said bent portion.

3. The connector according to claim 2, wherein said plate-like portion and said holding portion are different in level from each other.

4. The connector according to claim 2, wherein said terminal portion is connected to said plate-like portion with a stepped portion formed therebetween.

5. The connector according to claim 1, wherein the first and the second signal contacts respectively comprise holding portions, said holding portion of the second signal contact is adjacent to said holding portion of the shield contact, and said shielding portion includes an opening portion corresponding to said holding portion of the second signal contact.

6. The connector according to claim 1, wherein said contacting portions of the first and second signal contacts are parallel to said contacting portion of the shield contact and are adapted to be contacted with said mating object.

7. The connector according to claim 1, wherein said first and said second signal contacts comprise respective terminal portions which are parallel to said terminal portion of the shield contact.

8. A connector comprising a plurality of contact sets, each of the contact sets comprising:

a conductive first signal contact which comprises a contacting portion;

a conductive second signal contact which comprises a contacting portion positioned parallel to the contacting portion of the first signal contact in a plane;

a conductive shield contact; and a housing holding said first signal contact, said second signal contact and said shield contact, wherein said shield contact comprises:

a holding portion held by said housing;

a contacting portion which extends from said holding portion and in said plane in which the contacting portions of the first and second signal contacts are parallel, and which is adapted to be contacted with a mating object;

a shielding portion extending from said holding portion to cover a portion of said first signal contact and a portion of said second signal contact; and a terminal portion extending from said shielding portion and adapted to be connecting with ground.

9. The connector according to claim 8, wherein said contact sets are arranged around a common center point and oppose each other to be spaced apart in a radial direction of said common center point.

10. The connector according to claim 9, wherein said shielding portion comprises a curved portion that has a center of curvature coincident with said common center point.

* * * * *